United States Patent [19]

Bruneau

[11] Patent Number: 4,732,433

[45] Date of Patent: Mar. 22, 1988

[54] DEVICE PREVENTING THE SIMULTANEOUS OPENING OF A PLURALITY OF SUPERPOSED DRAWERS IN A COMMON PIECE OF FURNITURE

[75] Inventor: Alain Bruneau, Montferrand le Chateau, France

[73] Assignee: Alpia S.A., Besancon, France

[21] Appl. No.: 889,817

[22] Filed: Jul. 24, 1986

[30] Foreign Application Priority Data

Jul. 30, 1985 [FR] France ..... 85 12055

[51] Int. Cl.[4] ..... E05B 65/46

[52] U.S. Cl. ..... 312/221; 312/220

[58] Field of Search ..... 312/220, 221, 216, 217

[56] References Cited

U.S. PATENT DOCUMENTS

| | | | |
|---|---|---|---|
| 950,813 | 3/1910 | Bodenstein | 312/221 X |
| 1,613,731 | 1/1927 | Stockov | 312/221 |
| 1,744,646 | 1/1930 | Kurten | 312/221 |
| 2,240,067 | 4/1941 | Bolesky et al. | 312/221 |
| 3,969,008 | 7/1976 | Pergler | 312/221 |
| 4,239,309 | 12/1980 | DeFouw et al. | 312/221 |
| 4,425,013 | 1/1984 | Killen | 312/221 X |
| 4,441,767 | 4/1984 | Stark | 312/221 X |

FOREIGN PATENT DOCUMENTS

| | | | |
|---|---|---|---|
| 2740816 | 3/1979 | Fed. Rep. of Germany | 312/221 |
| 3412072 | 10/1985 | Fed. Rep. of Germany | 312/221 |
| 695363 | 12/1930 | France | 312/221 |
| A2063355 | 6/1981 | United Kingdom | 312/221 |

*Primary Examiner*—Peter A. Aschenbrenner
*Assistant Examiner*—Thomas A. Rendos
*Attorney, Agent, or Firm*—Emmanuel J. Lobato; Robert E. Burns

[57] ABSTRACT

Device consisting of a safety bar (2) preventing the simultaneous opening of a plurality of drawers (A, B, C), said bar being free to slide between a bottom stop (D) and a top stop (E) in a slide guide (G) fixed against a side wall (100) of the cabinet (1), parallel to a vertical edge (101) bordering the face on which the drawers open. This bar carries pivots provided with rotating rollers (1A, 1B, 1B', 1C) judiciously distributed over its face directed towards the drawers, and cooperates with rails (120, 20, 30) fixed on a side face of each drawer, parallel to and near its bottom.

5 Claims, 5 Drawing Figures

DEVICE PREVENTING THE SIMULTANEOUS OPENING OF A PLURALITY OF SUPERPOSED DRAWERS IN A COMMON PIECE OF FURNITURE

FIELD OF THE INVENTION

The invention relates to office furniture used for storing files, particularly furniture having superposed sliding drawers.

The problem posed by such furniture is due to the fact that for obvious reasons of space saving and accessibility of the files, the drawers have a length equal to three or four times their width. This results in considerable overhang when a drawer is pulled right out, and the cabinet will tip over if the weight lying on the lever formed by an open drawer gives rise to a pair of forces exceeding the cabinet's resistance to overturning.

PRIOR ART

The device described in French Pat. No. 1 568 229 (BRUNEAU) is characterized essentially in that means are provided for locking all the drawers except one by inclined side rails fastened to the drawers and each cooperating with a roller fastened to the locking rail,in such a manner that only one drawer can be opened at a time.

The drawer locking bar is controlled either by the lock or by the opening of the drawers:

by the lock: the eccentric of the lock raises the bar as it turns.

by the drawer: when one of the drawers is opened the ramp (10) raises the bar (4) by means of the roller (8).

The arrangement works well if only one drawer is opened at a time, but if a badly arranged file or any other cause entails the simultaneous opening of two or three drawers, the ramps (10) will raise the bar at the same time and two or three drawers will open simultaneously.

The problem to be solved is that of installing a device capable of preventing the simultaneous opening of a plurality of drawers.

SUMMARY OF THE INVENTION

To this end, the device according to the invention is characterized by the fact that it is composed of at least one safety bar preventing the simultaneous opening of a plurality of drawers (A, B, C) sliding freely between a bottom stop (D) and a top stop (E) in a slide guide (G) fixed against an internal side wall of the cabinet, parallel to a vertical edge bordering the face on which the drawers open, said bar carrying pivots provided with rotating rollers and judiciously distributed over that face of the bar which is directed towards the drawers, and said bar cooperating with rails fixed on at least one side face of each drawer, parallel to and near the bottom of the drawer; by the fact that the safety bar is displaced in the upward direction solely by the action of the rail of the drawers A or B, in the course of their opening, on the roller facing it, while the other rollers, which have been displaced with the bar carrying them by said drawer, lock the rails of the other drawers in order to prevent their simultaneous opening; and by the fact that on the closing of the previously opened drawer the safety bar will through the action of its own weight place a roller in front of the rail of each drawer A or B, with the exception of the bottom drawer (C), which can open without changing the position of the bar, but which locks the latter as soon as it is opened, thus preventing the opening of the drawers A and B.

The spacing of the rollers on the safety bar of the drawers is determined by the width of the rail of the center drawer passing between the two center rollers.

The top roller is disposed in such a manner as to correspond to the top of the rail of the top drawer.

The bottom roller is disposed in such a manner as to correspond to the bottom of the rail of the bottom drawer.

That end of the rails which is directed towards the outer face of the drawers and is situated near that face is dihedral in shape.

The principal advantage of the device according to the invention consists in that the opening of a drawer, after the key has been turned to release the independent locking means, raises or locks the safety bar, which, sliding freely in its guide between two reference positions, will place at least one roller in front of the rail of each of the drawers A and B, thus preventing their simultaneous opening. The closing of this drawer will return the rollers, through the sliding of the safety bar carrying them, to a position such that the rail of each drawer A and B will bear against a roller. An independent known device enables the cabinet to be locked with the key.

Other advantages will emerge from the description of one embodiment, given as a preferred but not limitative example, and from the drawings, in which:

DESCRIPTION OF THE PREFERRED EMBODIMENT

Figure 1:
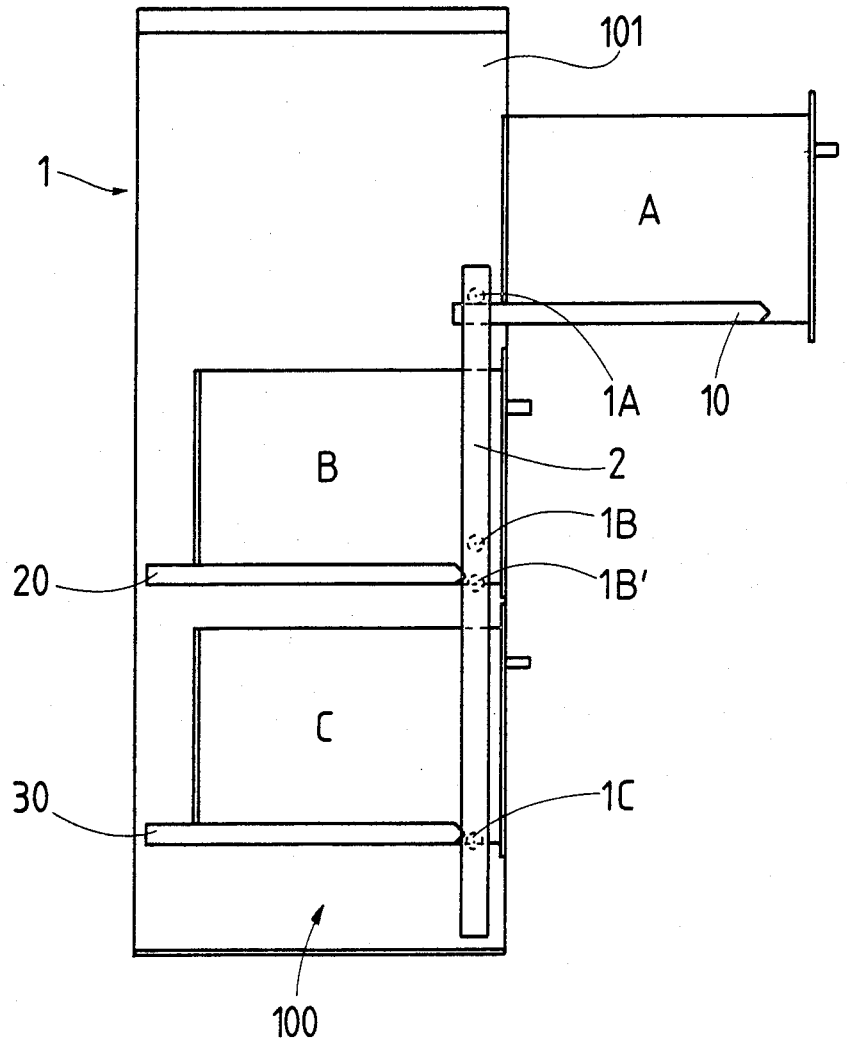
FIG. 1 is a sectional view of a cabinet comprising three superposed drawers.

FIG. 1 is a schematic section of a cabinet comprising three superposed drawers A, B, C contained in the same cabinet 1 and movable on parallel guide rails (not shown).

In order to prevent the simultaneous opening of a plurality of drawers, which would entail the risk of overturning the cabinet 1, a rigid bar 2 is free to slide between a top stop E and a bottom stop D in a guide G fixed on one side face 100 inside the cabinet 1, parallel to a vertical edge 101 situated near that face of the cabinet on which the drawers open.

This bar 2 carries pivots provided with rotating rollers 1A, 1B, 1B', 1C serving to prevent the opening of the other drawers when one drawer has been opened.

The distance between the rollers 1A, 1B, 1B' 1C on the bar 2 is determined by the width of the rail 20 of the drawer B passing between the two rollers 18 and 18' when it is opened. The rollers 1A and 1C are disposed in such a manner as to correspond respectively to the top 10' of the rail 10 of the drawer A and to the bottom 30'' of the rail 30 of the drawer C.

When the center drawer is opened, the other rails 10, 30 then each bear against a single roller 1A, 1C, which thus prevent the opening of the other drawers A and C.

Each drawer is provided on its side face directed towards the bar 2 with a rail 10, 20, 30 fixed parallel to its bottom. The end of each rail situated facing the outer face of the drawer has a dihedral shape in order to facilitate its passage above, below or between the rollers 1A, 1B, 1B', 1C judiciously distributed on the bar 2.

Figure 2:
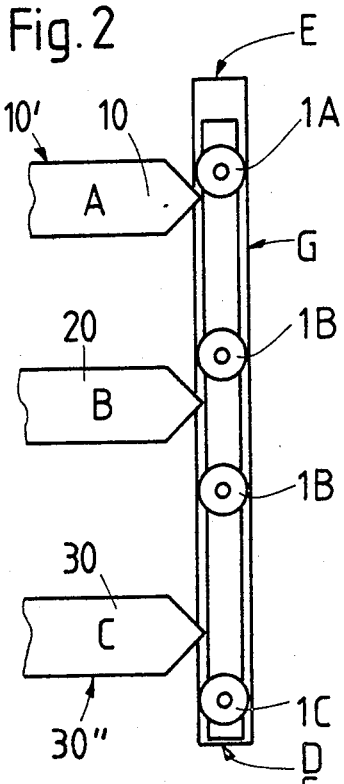
FIG. 2 is a diagram of the respective positions of the drawer rails and of the rollers when the three drawers are closed.

The function of the bar 2 can be explained as follows:

in the zero position (FIG. 2) the drawers A, B, C are closed; the bar carrying the rollers 1A, 1B, 1B', 1C is in the lower position against the bottom stop D;

the drawers A and B cannot be opened without entailing the lifting of the bar 2 with the aid of the rollers 1A or 1B;

the drawer C can be opened without changing the position of the bar 2 (see position 1).

Figure 3:
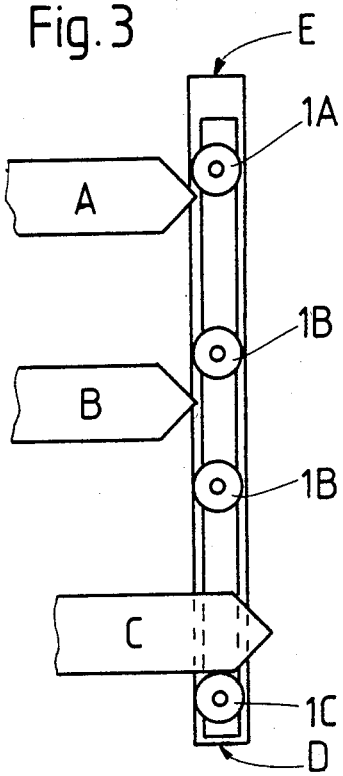
FIGS. 3, 4 and 5 are diagrams of the opening of each of the three drawers.

In position 1 (FIG. 3) the drawer C is open, and the drawers A and B are closed. The opening of the drawer C is possible without changing the position of bar 2 against the bottom stop D, but the latter is locked and the rollers 1A and 1B prevent the opening of the drawers A and B"

Figure 4:
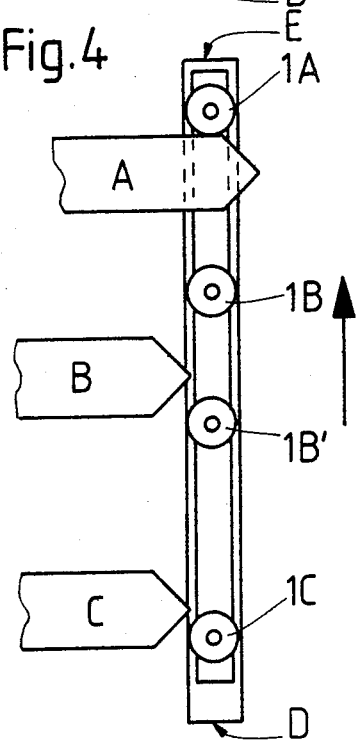

In position 2 (FIG. 4) the drawer A is open and the drawers B and C are closed. The opening of the drawer A raises the bar 2 by means of the top 10' of its rail acting on the roller 1A. This sliding of the bar 2 places the rollers 1B' and 1C in front of the rails 20 and 30, thus preventing the simultaneous opening of the drawers B and C.

Figure 5:
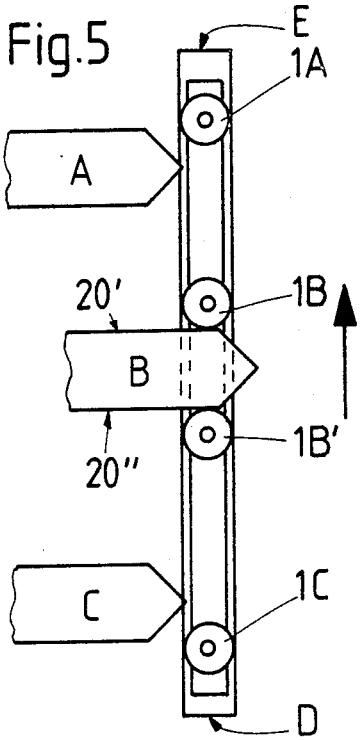

In position 3 (FIG. 5) the drawer B is open and the drawers A and C are closed. The opening of the drawer B raises the bar 2 by means of the top 20' of its rail 20, acting on the roller 1B; the bottom 20" of its rail 20 bears against the roller 1B', thus preventing any other displacement of the bar as long as the drawer B is open. In this position, in fact, the rail 10 of the drawer A bears against the roller 1A and the rail 30 of the drawer C bears against the roller 1C.

I claim:

1. For use in a cabinet having a plurality of drawers movable from a closed position to a front of the cabinet for opening thereof and toward a rear of the cabinet for closing thereof, a semiautomatic safety mechanism for enabling any one of the drawers to be opened when all the drawers are closed and for enabling only one closed drawer to be opened at a time comprising, a single vertical guide mountable in use vertically inside of a side of the cabinet adjacent to the front of the cabinet, a single rigid safety bar freely slidable vertically in said vertical guide to a terminal raised position and to a terminal lowered position as individual drawers are opened and closed, said safety bar having a plurality of rollers rotatably mounted thereon spaced longitudinally on the safety bar, each drawer having a rigid rail mounted along a side thereof, each drawer other than a lowermost drawer having said rail thereof disposed for coaction with a corresponding roller on said safety bar for activating the safety bar individually to move the safety bar longitudinally upwardly only as individual closed drawers other than said lowermost drawer are opened and for effectively allowing the safety bar to move downwardly under control of the individual rails of said drawers when restored to a closed condition, said rollers being disposed on said safety bar at fixed points of rotation thereon to move upwardly and downwardly with the safety bar to operative positions for effecting cooperation with the corresponding individual rails on the individual drawers for enabling individually the corresponding individual rails to ride on a corresponding roller only one at a time for enabling opening of only one drawer at a time and at said operative positions effectively disenabling the opening of closed drawers other than the drawer corresponding to the enabled individual rail, each rail having a leading end for cooperating with the corresponding roller and configured for lifting of the safety bar progressively as the corresponding drawer is opened and for allowing the safety bar to move downwardly progressively, as the corresponding drawer is closed, said safety bar being disposed at said terminal lowered position when all said drawers are closed and the rollers thereon being disposed effectively enabling any one of all the closed drawers to be opened only one at a time, and the rigid rail of the lowermost drawer being disposed for bearing on a lowermost roller on said safety bar to preclude moving the safety bar upwardly when said lowermost drawer is opened with said safety bar disposed at said terminal lowered position whereby when the lowermost drawer is opened no other drawer can be opened until the lowermost drawer is closed.

2. For use in a cabinet having a plurality of drawers movable to a front of the cabinet for opening and movable toward a rear of the cabinet for closing thereof according to claim 1, in which said cabinet has three drawers, and in which said safety bar has four rollers thereon on a same side of the safety bar.

3. For use in a cabinet having a plurality of drawers movable to a front of the cabinet for opening and movable toward a rear of the cabinet for closing thereof according to claim 2, in which two of said four rollers are disposed spaced on said safety bar for having the rail of a middle one of said three drawers rolling between both said two rollers when said middle drawer is opened.

4. For use in a cabinet having a plurality of drawers movable to a front of the cabinet for opening and movable toward a rear of the cabinet for closing thereof according to claim 1, in which each leading end of each rail is diehedral in shape.

5. For use in a cabinet having a plurality of drawers movable to a front of the cabinet for opening and movable toward a rear of the cabinet for closing thereof according to claim 1, in which said terminal raised position and to said terminal lowered position are defined by said guide for said safety bar.

* * * * *